US012624635B2

(12) United States Patent
Fevang

(10) Patent No.: US 12,624,635 B2
(45) Date of Patent: May 12, 2026

(54) FLUID PROPERTY ESTIMATION BASED ON ELECTROMAGNETIC MEASUREMENTS

(71) Applicant: Baker Hughes Oilfield Operations LLC, Houston, TX (US)

(72) Inventor: Finn Oivind Fevang, Tananger (NO)

( * ) Notice: Subject to any disclaimer, the term of this patent is extended or adjusted under 35 U.S.C. 154(b) by 385 days.

(21) Appl. No.: 18/347,175

(22) Filed: Jul. 5, 2023

(65) Prior Publication Data

US 2025/0012183 A1 Jan. 9, 2025

(51) Int. Cl.
*E21B 47/113* (2012.01)
*E21B 43/12* (2006.01)
*E21B 49/08* (2006.01)

(52) U.S. Cl.
CPC ..... *E21B 47/113* (2020.05); *E21B 43/12* (2013.01); *E21B 49/08* (2013.01)

(58) Field of Classification Search
CPC ..... E21B 47/113; E21B 43/12; E21B 49/08
See application file for complete search history.

(56) References Cited

U.S. PATENT DOCUMENTS 5,341,100 A * 8/1994 Taylor ..... G01V 3/30 73/152.24
9,567,843 B2 2/2017 Saeed et al.
9,976,415 B2 5/2018 Logan et al.
11,085,294 B2 * 8/2021 Dai ..... E21B 49/081
11,333,538 B2 5/2022 Mahalingham et al.
2011/0088895 A1 * 4/2011 Pop ..... E21B 44/00 166/254.2
2013/0338926 A1 * 12/2013 Gzara ..... E21B 43/00 702/8
2020/0166478 A1 * 5/2020 Mohr ..... G01N 9/26

FOREIGN PATENT DOCUMENTS

CN 207499826 U 6/2018
GB 2443374 A * 4/2008 ..... E21B 47/135
WO 2020005850 A1 1/2020
WO 2020231923 A1 11/2020

OTHER PUBLICATIONS

Brezina, Benedikt; "Analysis of Flow Behavior in Mud Return Lines of Open System Drilling Rigs"; Department Petroleum Engineering; Montan Universitat; Master Thesis; 2016; 4 pages.
International Search Report for International Application No. PCT/US2024/036627, International Filing Date Jul. 3, 2024, Date of Mailing Oct. 10, 2024, 4 pages.
(Continued)

*Primary Examiner* — Catherine T. Rastovski
*Assistant Examiner* — Nyla Gavia
(74) *Attorney, Agent, or Firm* — Baker Hughes Company

(57) ABSTRACT

A method of a method of analyzing a fluid includes measuring a conductive flow of a fluid circulating through a borehole during a subterranean operation, the conductive flow indicative of an electrically conductive constituent of the fluid. The method also includes measuring a total flow of the fluid concurrently with the measuring of the conductive flow, and estimating a property of the fluid in real time during the subterranean operation based on the conductive flow and the total flow.

20 Claims, 3 Drawing Sheets

(56) References Cited

OTHER PUBLICATIONS

Liu et al., "Real-Time Measurement of Drilling Fluid Rheological Properties: A Review"; Sensors 2021, 21; May 21, 2021; 3 pages.
SiCon Simultaneous Concentration (Real-time Retort); Technical Information; Retrieved Nov. 29, 2022; 1 page.
Written Opinion for International Application No. PCT/US2024/036627, International Filing Date Jul. 3, 2024, Date of Mailing Oct. 10, 2024, 4 pages.
Zhang et al., "Effect of Electrical Conductive Property on Electromagnetic Flow Meter"; AMA Conferences 2015—Sensor 2015; 4 pages.
Optiflux 7300 Handbook "Electronmagentic flowmeter with non wetted electrodes and ceramic liner" Krohne Jul. 2020 44 pages.

* cited by examiner

FLUID PROPERTY ESTIMATION BASED ON ELECTROMAGNETIC MEASUREMENTS

BACKGROUND

Borehole drilling is utilized in a number of applications, including exploration and production of natural gases and fluids, mineral extraction, gas storage, waste disposal, carbon dioxide sequestration, geothermal production and others. For example, in hydrocarbon exploration and production operations, boreholes are drilled deep into the earth to access hydrocarbon-bearing formations. A drilling fluid is typically circulated in a borehole during drilling to facilitate maintaining borehole stability, lubricating a drill bit and removing cuttings from a borehole. Drilling fluids may be oil-based or water-based, and include various components for controlling properties such as viscosity and density.

SUMMARY

An embodiment of a method of analyzing a fluid includes measuring a conductive flow of a fluid circulating through a borehole during a subterranean operation, the conductive flow indicative of an electrically conductive constituent of the fluid. The method also includes measuring a total flow of the fluid concurrently with the measuring of the conductive flow, and estimating a property of the fluid in real time during the subterranean operation based on the conductive flow and the total flow.

An embodiment of a system for analyzing a fluid includes an electromagnetic flow meter configured to perform a measurement of a conductive flow of a fluid circulating through a borehole during a subterranean operation, the conductive flow indicative of an electrically conductive constituent of the fluid. The system also includes a second flow meter configured to perform a measurement of a total flow of the fluid concurrently with the measurement of the conductive flow, and a processor configured to estimating a property of the fluid in real time during the subterranean operation based on the conductive flow and the total flow.

BRIEF DESCRIPTION OF THE DRAWINGS

The following descriptions should not be considered limiting in any way. With reference to the accompanying drawings, like elements are numbered alike.

DETAILED DESCRIPTION

Systems and methods are provided for estimating properties of fluids in a borehole or subterranean environment. Fluid estimation, in an embodiment, is performed at a surface location. A fluid may include a combination of an injected or circulated fluid such as drilling mud, and other constituents such as formation fluid and solids (e.g., cuttings). A "formation fluid" refers to any fluid or combination of fluids that are in a hydrocarbon-bearing formation or other region, and is not limited to fluid from any specific type of region or formation. Formation fluids can include various combinations of hydrocarbons (e.g., oil and/or gas), non-hydrocarbon gases, water and others.

An embodiment of a fluid analysis system includes an electromagnetic flow meter configured to measure a flow of conductive fluid constituents (conductive flow) in a fluid that is circulating through a borehole, and an additional flow meter configured to measure a total flow of the fluid. "Conductive flow" of a fluid may include various fluid parameters related to conductive constituents of the fluid, such as flow rate, volume, conductivity and others.

The additional flow meter, in an embodiment, is a mass flow meter configured to measure a total flow of the fluid. The additional flow meter may be any suitable type of measurement device or method of establishing a volume of fluid in the electromagnetic flow meter (e.g., fixed flowrate metering).

"Total flow" of a fluid may include fluid parameters related to the overall or total mass of the fluid, such as mass flow rate, total mass flow, volumetric flow rate, total volume flow and others. Measurements of conductive flow and total flow are used in combination to estimate properties of the fluid. Examples of such properties include proportions of oil, water and/or solids in the fluid. Other examples include salinity and electrical stability.

Embodiments described herein present numerous advantages and technical effects. The embodiments provide an effective method to evaluate fluid composition and downhole conditions related to circulation of fluid, which allows for timely adjustments of drilling fluid composition, drilling rate or other operational parameters. In addition, the embodiments can provide for remote monitoring of drilling fluids, live or real time measurements of the quality and condition of drilling fluids, and automated fluid management (monitoring and/or adjustment of fluid properties).

Typically, fluid is monitored by periodically extracting samples of return fluid and performing retort analysis to determine the content of oil, water and solids. Such analysis is performed by separating the fluid sample and individually measuring the oil, water and solids components. Embodiments provide an improvement over such methods by providing faster results and allowing for real time measurements.

Figure 1:
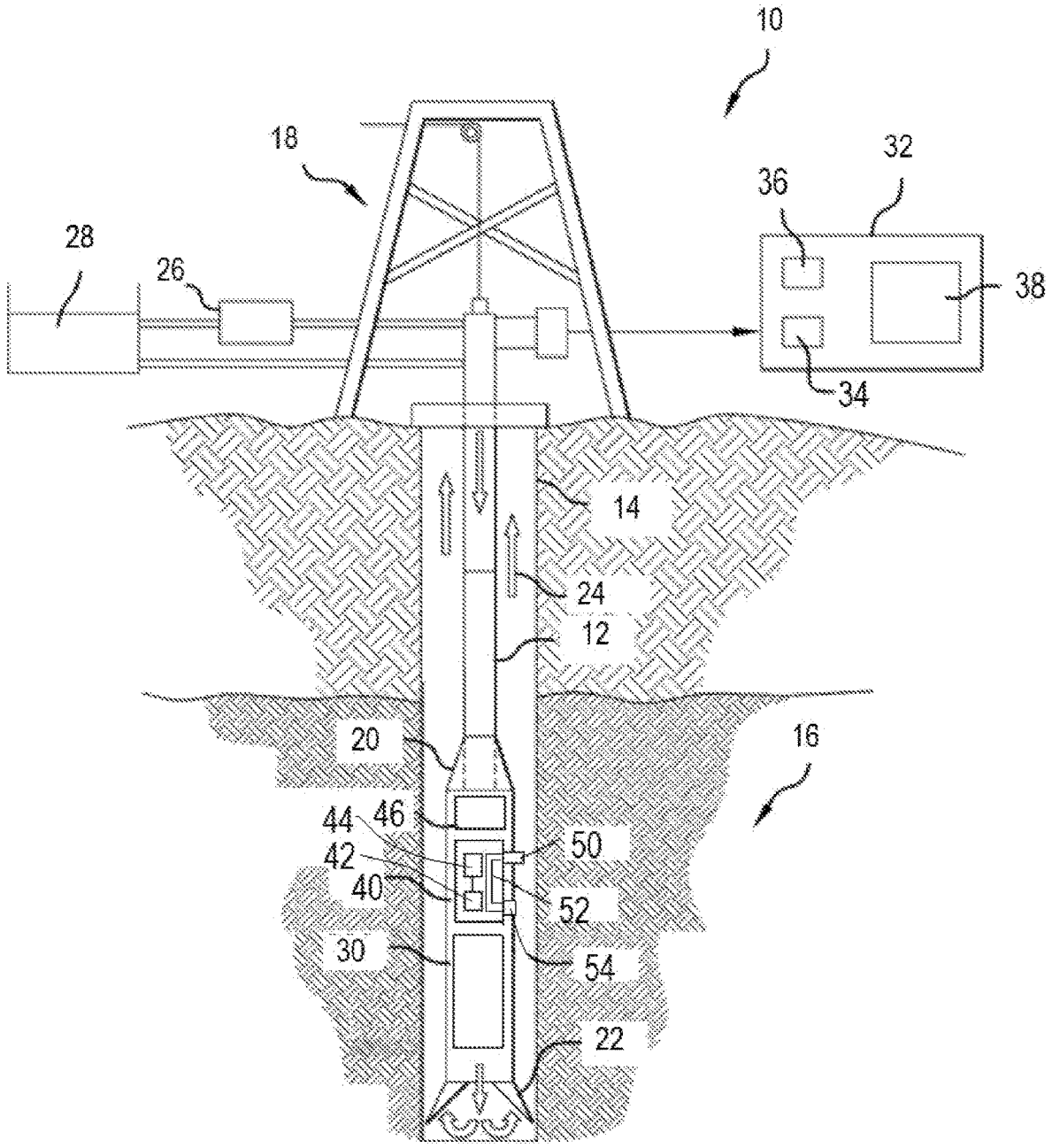
FIG. 1 depicts an embodiment of a system configured for performing subterranean operations, including a fluid analysis system configured to perform downhole measurements of a fluid.
Figure 2:
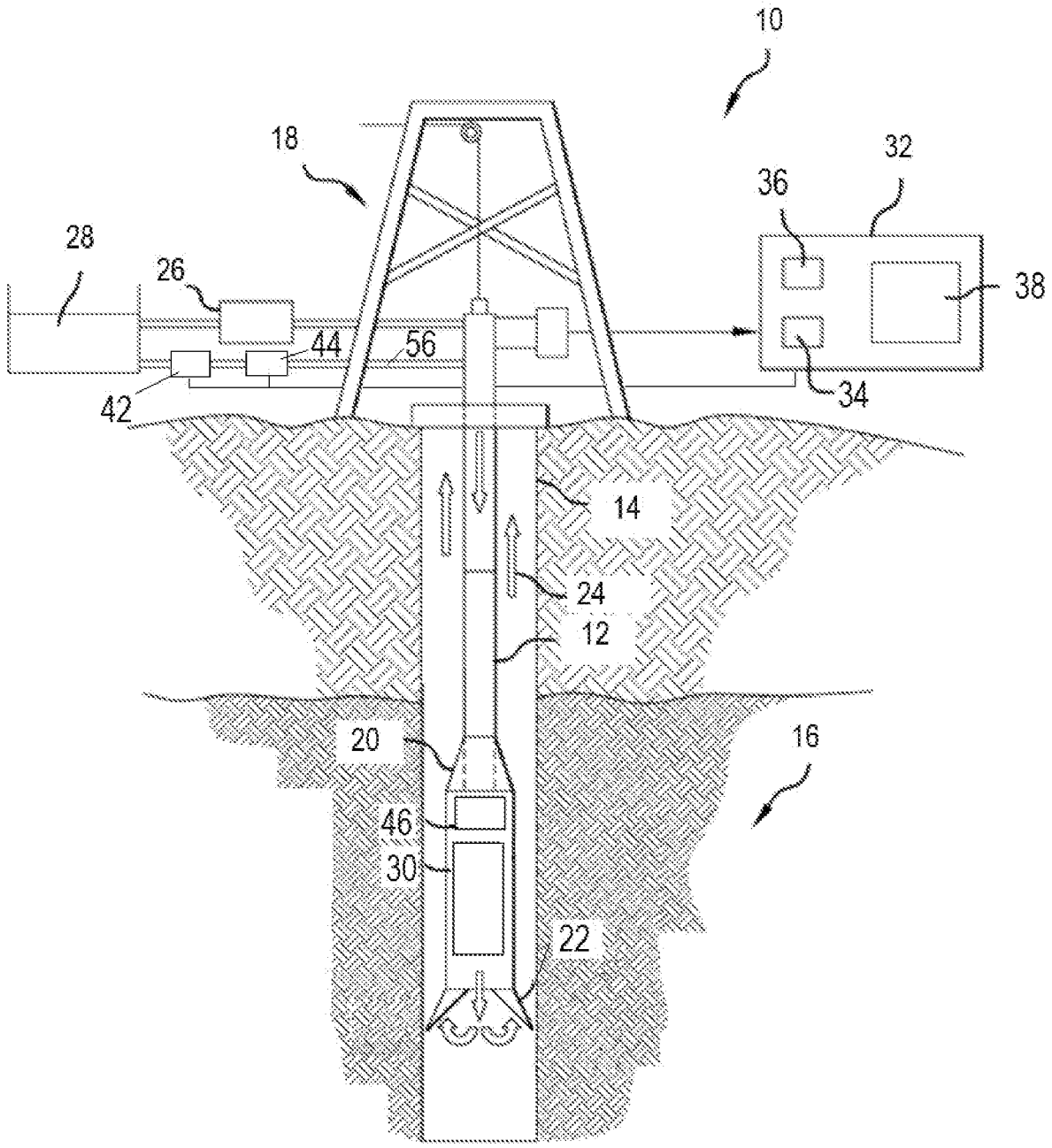
FIG. 2 depicts an embodiment of a system configured for performing subterranean operations, including a fluid analysis system configured to perform surface measurements of a fluid.

FIGS. 1 and 2 show embodiments of a system 10 for performing a subterranean operation (e.g., measurement, survey, drilling, stimulation and/or production). The system 10 includes a borehole string 12 that is shown disposed in a well or borehole 14 that penetrates a subterranean region 16 (including, for example, at least one earth formation).

The system 10 is shown as a drilling system in FIGS. 1 and 2; however, embodiments described herein are not so limited. Embodiments may be applicable to various systems, such as wireline systems, coiled tubing systems, production systems, and others.

In an embodiment, the borehole string 12 is a drill string operably connected to a surface structure or surface equipment 18 such as a drill rig. The drill string 12 is connected to a bottomhole assembly (BHA) 20 including a drill bit 22. The drill string 12 may be driven from the surface, or may be driven from downhole, e.g., by a downhole mud motor (not shown). It is noted that embodiments described herein are not limited to use with drill strings or drilling systems.

The surface equipment 18 includes various components such as a surface drive or rotary table for supporting the borehole string 12, rotating the drill string 12 and lowering string sections or other downhole components. In addition, the surface equipment 18 includes components to facilitate circulating fluid 24 such as drilling mud through the drill string 12 and an annulus between the drill string 12 and the borehole wall. For example, a pumping device 26 is located at the surface to circulate the fluid 24 from a mud pit or other fluid source 28.

The system 10 may include one or more of various tools configured to perform selected functions downhole such as performing downhole measurements and facilitating communications. For example, one or more downhole tools 30 may be included for performing measurements such as logging while drilling (LWD) or measurement while drilling (MWD) measurements. Examples of tools 30 include formation evaluation tools such as a gamma tool, a resistivity tool, a sampling tool, a density tool, a nuclear magnetic resonance tool, and/or an acoustic tool. Other examples include tools for measuring directional parameters.

One or more downhole components and/or one or more surface components may be in communication with and/or controlled by a processing device or system, such as a surface processing unit 32. The surface processing unit 32, in an embodiment, includes an input/output (I/O) device 34, a processor 36, and a data storage device 38 (e.g., memory, computer-readable media, etc.) for storing data, models and/or computer programs or software that cause the processor to perform aspects of methods and processes described herein.

The system 10 also includes a fluid analysis system 40 configured to estimate one or more properties of the fluid 24 or other desired fluid. The fluid analysis device 40 includes an electromagnetic flow meter 42 in fluid communication with the fluid 24 in an annulus of the borehole 14. The electromagnetic (EM) flow meter 42 is configured to generate a magnetic field and measure a voltage generated by fluid flowing through or proximate to the EM flow meter 42.

Fluid circulated through a borehole typically includes a combination of constituent fluids and materials (referred to herein as "constituents"). Such fluid typically includes drilling fluid constituents, formation fluids and materials, and cuttings from drill bit interactions. The drilling fluid may be an oil-based fluid or a water-based fluid that includes various additives.

Fluid constituents, such as oil, water and solids, have different conductivities that affect voltage signals detected by the EM flow meter 42. Such voltage measurements can be used to measure the conductive flow (i.e., a flow of conductive constituents) and estimate aspects of fluid composition, as well as other fluid properties (e.g., flow rate).

The EM flow meter 42 can measure conductivity that is greater than a minimum conductivity value. For example, voltages can be detected from fluids having a conductivity as low as 0.05 micro-Siemens/centimeter (μS/cm). The base oil of oil-based drilling muds is typically lower than 0.05 μS/cm; thus, the base oil does not affect the voltage measurements. Water and solids typically have higher conductivities and thus can be detected. Detected voltages (or changes in voltage) may be correlated with conductive constituents based on previously determined calibration values. For example, changes in voltage can be correlated with changes in the volume of cuttings and/or water.

The fluid analysis system 40 includes an additional fluid measurement device. In an embodiment, the additional fluid measurement device is a flow meter 44 that is configured to measure an overall flow of the fluid ("total flow").

The flow meter 44, in an embodiment, is a Coriolis flow meter. Other types of flow rate measurement devices may be used as the flow meter 44. Examples of types of suitable flow rate measurement devices include differential pressure flow meters, variable area flow meters, ultrasonic flow meters or any other devices that can be used to measure total flow.

The fluid analysis system 40, in the embodiment of FIG. 1, is configured as a downhole fluid analysis tool that houses the flow meters 42 and 44. Measurements from the fluid analysis system 40 may be stored downhole for later retrieval, or transmitted to the surface (e.g., for real time monitoring). For example, the fluid analysis system 40 can be communicatively connected to a downhole processing device 46 that can perform functions such as storing measurement data, analyzing measurement data and/or communicating with the surface.

The fluid analysis system 40 may communicate with surface or remote devices such as the surface processing unit 32. Communication can be realized through any of various communication systems, such as wired pipe or mud pulse telemetry. The surface processing unit 32 may be configured to communicate with downhole components, store data, analyze measurements and perform other desired functions.

The fluid analysis system 40 may perform downhole fluid measurements in various ways. For example, as shown in FIG. 1, the fluid analysis system 40 includes components for extracting fluid for analysis, which include a laterally extendable extraction port 50 in fluid communication with a flow line 52 and an exit port 54. A portion of the fluid 24 in the borehole annulus is diverted through the flow line 50, flows through a magnetic field region established by the EM flow meter 42, and flows through the flow meter 44.

Embodiments are not limited to the configuration shown in FIG. 1. For example, downhole fluid measurements may be performed based on extracting a fluid sample into a sample chamber. In another example, the EM flow meter 42 may be configured to measure fluid in the annulus directly by applying a magnetic field in the annulus.

In addition to downhole measurements, or alternatively, the system 10 may be configured to perform fluid measurements at the surface. For example, as shown in FIG. 2, the EM flow meter 42 and the additional flow meter 44 are configured to perform measurements of fluid retrieved from the borehole 14 through a return line 56 that receives fluid 24 flowing through the annulus toward the surface.

Figure 3:
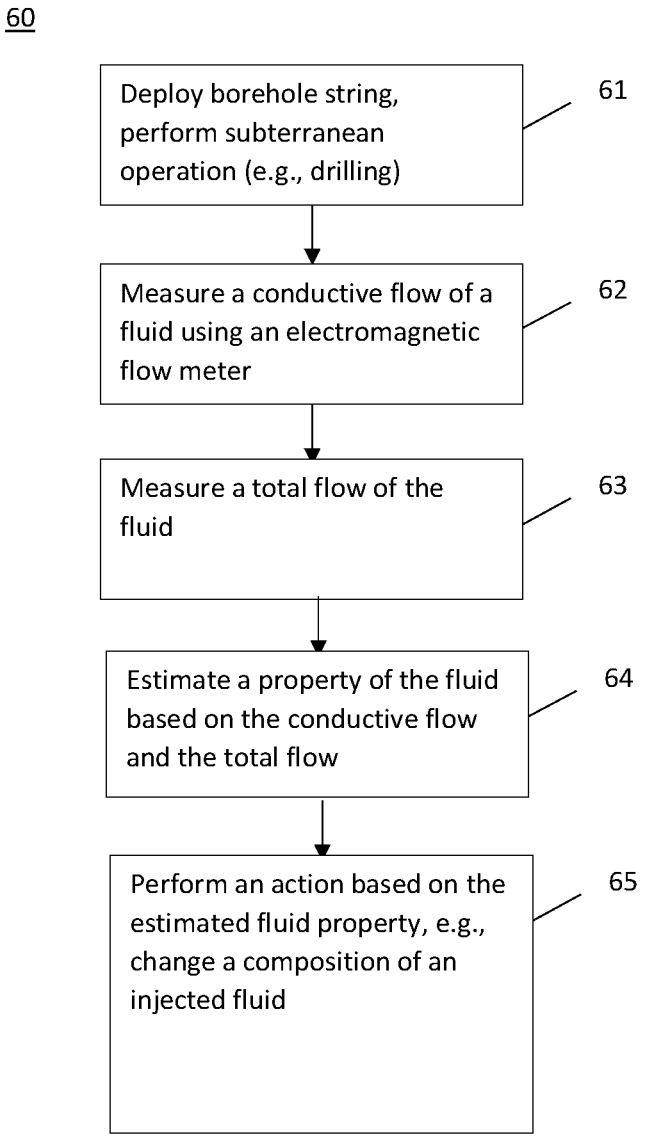
FIG. 3 is a flow diagram depicting an embodiment of a method of analyzing fluid in or from a downhole system, such as a drilling system.

FIG. 3 illustrates a method 60 of analyzing a fluid. The method 160 includes one or more of stages 61-65 described herein, at least portions of which may be performed by a processor (e.g., the downhole processing device 46 and/or the surface processing unit 32). In one embodiment, the method 60 includes the execution of all of stages 61-65 in the order described. However, certain stages may be omitted, stages may be added, or the order of the stages changed.

The method 60 may be performed at various times and under various conditions. For example, fluid can be analyzed downhole or at the surface on a real time basis (e.g., as samples are collected or otherwise during an operation), and/or measurement data can be stored and analyzed at other times.

Aspects of the method 60 are discussed in conjunction with the system 10 of FIG. 1. However, the method is not so limited, and can be performed in conjunction with the system 10 of FIG. 2 and/or any other system for which fluid monitoring or analysis is desired.

In the first stage 61, a borehole string such as the drill string 12 is deployed into a borehole, and a subterranean operation is performed. In an embodiment, the operation is a drilling operation. For example, drilling fluid is injected into the drill string 12, flows through the BHA 20 and returns as fluid 24 to the surface. As the drilling fluid circulates, materials such as formation fluids and cuttings are mixed with the drilling fluid.

In the second stage 62, the electromagnetic flow meter is used to measure a conductive flow, or fluid properties associated with conductive constituents of the fluid. An electromagnetic flow meter, such as the EM flow meter 42, applied a static magnetic field to a flow of fluid. For example, a portion of the fluid 24 in the annulus is diverted through the flow line 52, a static magnetic field is applied to the flow line 52, and voltage is detected over as given measurement time window. The conductive flow may be measured continuously to provide real time measurement data.

In the third stage 63, a total flow of the fluid is estimated using a Coriolis flow meter, such as the flow meter 44, or other measurement device capable of measuring a total or overall mass flow of the fluid. In an embodiment, measurements of the total flow are provided as a baseline or reference value that can be used to accurately determine changes in fluid composition, including changes in conductive flow.

The measurements of stages 63 and 64 may be performed simultaneously or concurrently. For example, the flow meters 42 and 44 are used to simultaneously perform measurements as fluid flows through the flow line 52. As described herein "concurrent" measurements are measurements that are performed sufficiently close in time so that measurements from both flow meters 42 and 44 relate to substantially the same volume of fluid or at least overlapping volumes of fluid.

In the fourth stage 64, the conductive flow measurement and the total flow measurements are analyzed to determine one or more properties of the fluid. Properties may include an amount (e.g., volume percentage) of oil, water and/or solids in the fluid. Other properties that can be derived include electrical stability (i.e., changes in conductivity of the fluid over time) and water phase salinity. In addition, to conductive and total flow measurements, additional information may be used, for example, to reduce uncertainties in determining a fluid property. Examples of such additional information include fluid density, composition, conductivity and/or salinity. The additional information may be calibration information for a specific fluid or fluid composition.

Conductive flow measurements are used to estimate the conductivity of the fluid, and relate the conductivity to conductive fluid parameters such as conductive constituents of the fluid, such as flow rate, volume, conductivity and others.

Conductive fluid parameters may be derived by correlating voltage measurements with volumes of constituents. For example, calibration data can be initially acquired based on measurements of drilling fluid before circulation and/or information regarding the composition of the drilling fluid. The calibration data may be reference voltages, which are compared to voltage measurements to determine changes in the types and/or amounts of conductive constituents.

Total flow measurements are used to estimate total fluid parameters such as total mass, total volume, mass flow rate, volumetric flow rate and others. Additional fluid parameters may be acquired, such as pressure and temperature, density and rheology from other sensors.

One or more conductive fluid parameters are combined and analyzed with one or more total fluid parameters, to derive a property of the fluid (e.g., the fluid 24). For example, a volume of cuttings in the fluid is estimated based on the conductive flow measurements, and the volume is compared to a total volume of the fluid to estimate a volume percentage of cuttings in the fluid. Similarly, a volume of water in the fluid is estimated based on the conductive flow measurements, and the volume is compared to a total volume of the fluid to estimate a volume percentage of water in the fluid.

The conductive flow measurements, the total flow measurements, and parameters derived therefrom, may be analyzed as changes or trends, such as changes in a volume of cuttings and/or other solids, changes in salinity, changes in water volume, and others.

In the fifth stage 65, various actions can be performed based on the estimated properties. Examples of actions include presenting results to a user or operator, and planning and/or adjusting operational parameters such as rotational rate, rate of penetration and others. Other actions may include adjusting or controlling the composition of injected fluid.

For example, a processing device such as the surface processing unit 32 automatically adjusts fluid properties based on the estimated fluid properties. Adjustments may be performed continuously (e.g., at each sample time or measurement time) or periodically during the operation to allow the system to timely react to changes in fluid conditions. In another example, the processing device monitors cuttings volume and/or composition of cuttings, and automatically adjusts operation parameters such as rotational rate, rate of penetration, and others.

Set forth below are some embodiments of the foregoing disclosure:

Embodiment 1: A method of analyzing a fluid, comprising: measuring a conductive flow of a fluid circulating through a borehole during a subterranean operation, the conductive flow indicative of an electrically conductive constituent of the fluid; measuring a total flow of the fluid concurrently with the measuring of the conductive flow; and estimating a property of the fluid in real time during the subterranean operation based on the conductive flow and the total flow.

Embodiment 2: The method as in any prior embodiment, wherein the fluid includes an injected fluid circulated through the borehole from a surface location, and the constituent includes at least one of formation fluid, oil, water and formation material.

Embodiment 3: The method as in any prior embodiment, wherein the injected fluid is a drilling fluid, and the formation material includes cuttings generated by interactions between a drill bit and a subterranean region.

Embodiment 4: The method as in any prior embodiment, wherein estimating the property includes estimating a proportion of a volume of the constituent relative to a total volume of the fluid.

Embodiment 5: The method as in any prior embodiment, wherein measuring the conductive flow is performed by an electromagnetic flow meter configured to apply a magnetic field to the fluid, and detect a voltage generated by the fluid.

Embodiment 6: The method as in any prior embodiment, wherein estimating the property includes determining a change in the detected voltage, and correlating the change in the detected voltage to a change in a proportion of the constituent.

Embodiment 7: The method as in any prior embodiment, wherein the change in the detected voltage is determined relative to the total flow.

Embodiment 8: The method as in any prior embodiment, wherein the conductive flow and the total flow are measured at a downhole location.

Embodiment 9: The method as in any prior embodiment, wherein the conductive flow and the total flow are measured for a volume of the fluid flowing through a return fluid line at a surface location.

Embodiment 10: The method as in any prior embodiment, further comprising automatically controlling, in real time, at least one of an operational parameter and a composition of an injected fluid based on the estimated property of the fluid.

Embodiment 11: A system for analyzing a fluid, comprising: an electromagnetic flow meter configured to perform a measurement of a conductive flow of a fluid circulating through a borehole during a subterranean operation, the conductive flow indicative of an electrically conductive constituent of the fluid; a second flow meter configured to perform a measurement of a total flow of the fluid concurrently with the measurement of the conductive flow; and a processor configured to estimating a property of the fluid in real time during the subterranean operation based on the conductive flow and the total flow.

Embodiment 12: The system as in any prior embodiment, wherein the fluid includes an injected fluid circulated through the borehole from a surface location, and the constituent includes at least one of formation fluid, oil, water and formation material.

Embodiment 13: The system as in any prior embodiment, wherein the injected fluid is a drilling fluid, and the formation material includes cuttings generated by interactions between a drill bit and a subterranean region.

Embodiment 14: The system of claim 11, wherein the processor is configured to estimate the property based on estimating a proportion of a volume of the constituent relative to a total volume of the fluid.

Embodiment 15: The system of claim 11, wherein the electromagnetic flow meter is configured to apply a magnetic field to the fluid, and detect a voltage generated by the fluid.

Embodiment 16: The system of claim 15, wherein the processor is configured to estimate the property based on determining a change in the detected voltage, and correlating the change in the detected voltage to a change in a proportion of the constituent.

Embodiment 17: The system of claim 16, wherein the change in the detected voltage is determined relative to the total flow.

Embodiment 18: The system of claim 11, wherein the conductive flow and the total flow are measured at a downhole location.

Embodiment 19: The system of claim 11, wherein the conductive flow and the total flow are measured for a volume of the fluid flowing through a return fluid line at a surface location.

Embodiment 20: The system of claim 11, wherein the processor is configured to automatically control, in real time, at least one of an operational parameter and a composition of an injected fluid based on the estimated property of the fluid.

As used herein generation of data in "real time" is taken to mean generation of data at a rate that is useful or adequate for making decisions during or concurrent with processes such as production, experimentation, verification, and other types of surveys or uses as may be opted for by a user. It should be recognized that "near real time" is to be taken in context, and does not necessarily indicate the instantaneous determination of data, or make any other suggestions about the temporal frequency of data collection and determination.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed:

1. A method of analyzing a fluid, comprising:

measuring a conductive flow of a fluid circulating through a borehole during a subterranean operation, the conductive flow indicative of an electrically conductive constituent of the fluid, wherein measuring the conductive flow includes applying a static magnetic field to the fluid, and detecting a voltage generated by the fluid;

measuring a total flow of the fluid concurrently with the measuring of the conductive flow; and estimating a property of the fluid in real time during the subterranean operation based on the conductive flow and the total flow; and controlling a composition of an injected fluid based on the estimated property of the fluid.

2. The method of claim 1, wherein the fluid includes the injected fluid circulated through the borehole from a surface location, and the constituent includes at least one of formation fluid, oil, water and formation material.

3. The method of claim 2, wherein the injected fluid is a drilling fluid, and the formation material includes cuttings generated by interactions between a drill bit and a subterranean region.

4. The method of claim 1, wherein estimating the property includes estimating a proportion of a volume of the constituent relative to a total volume of the fluid.

5. The method of claim 1, wherein measuring the conductive flow is performed by an electromagnetic flow meter disposed in a borehole string in the borehole.

6. The method of claim 1, wherein estimating the property includes determining a change in the detected voltage, and correlating the change in the detected voltage to a change in a proportion of the constituent.

7. The method of claim 6, wherein the change in the detected voltage is determined relative to the total flow.

8. The method of claim 1, wherein the conductive flow and the total flow are measured at a downhole location.

9. The method of claim 1, wherein the conductive flow and the total flow are measured for a volume of the fluid flowing through a return fluid line at a surface location.

10. The method of claim 1, further comprising automatically controlling, in real time, at least one of an operational parameter and the composition of the injected fluid based on the estimated property of the fluid.

11. A system for analyzing a fluid, comprising:

an electromagnetic flow meter configured to perform a measurement of a conductive flow of a fluid circulating through a borehole during a subterranean operation, the conductive flow indicative of an electrically conductive constituent of the fluid, wherein the electromagnetic flow meter is configured to measure the conductive flow based on applying a magnetic field to the fluid, and detecting a voltage generated by the fluid;

a second flow meter configured to perform a measurement of a total flow of the fluid concurrently with the measurement of the conductive flow; and a processor configured to estimating a property of the fluid in real time during the subterranean operation based on the conductive flow and the total flow, the processor configured to control a composition of an injected fluid based on the estimated property of the fluid.

12. The system of claim 11, wherein the fluid includes the injected fluid circulated through the borehole from a surface location, and the constituent includes at least one of formation fluid, oil, water and formation material.

13. The system of claim 12, wherein the injected fluid is a drilling fluid, and the formation material includes cuttings generated by interactions between a drill bit and a subterranean region.

14. The system of claim 11, wherein the processor is configured to estimate the property based on estimating a proportion of a volume of the constituent relative to a total volume of the fluid.

15. The system of claim 11, wherein the electromagnetic flow meter disposed in a borehole string in the borehole.

16. The system of claim 11, wherein the processor is configured to estimate the property based on determining a change in the detected voltage, and correlating the change in the detected voltage to a change in a proportion of the constituent.

17. The system of claim 16, wherein the change in the detected voltage is determined relative to the total flow.

18. The system of claim 11, wherein the conductive flow and the total flow are measured at a downhole location.

19. The system of claim 11, wherein the conductive flow and the total flow are measured for a volume of the fluid flowing through a return fluid line at a surface location.

20. The system of claim 11, wherein the processor is configured to automatically control, in real time, at least one of an operational parameter and the composition of an injected fluid based on the estimated property of the fluid.

* * * * *